US006299532B1

(12) United States Patent
Smith

(10) Patent No.: US 6,299,532 B1
(45) Date of Patent: Oct. 9, 2001

(54) FLUSH POKER CARD GAME

(76) Inventor: Karen A Smith, 885 Bowstring Rd., Monument, CO (US) 80132

( * ) Notice: Subject to any disclaimer, the term of this patent is extended or adjusted under 35 U.S.C. 154(b) by 0 days.

(21) Appl. No.: 09/633,392

(22) Filed: Aug. 4, 2000

(51) Int. Cl.[7] ..... A63F 1/00
(52) U.S. Cl. ..... 463/13; 273/292
(58) Field of Search ..... 273/292, 269, 273/139, 303–306, 236, 274; 463/13, 12

(56) References Cited

U.S. PATENT DOCUMENTS 4,480,840 * 11/1984 Chang ..... 273/292
5,417,430 * 5/1995 Breeding ..... 273/292
5,603,502 * 2/1997 Nakagawa ..... 273/292
5,823,873 * 10/1998 Moody ..... 463/13
5,921,549 * 7/1999 Wilson et al. ..... 273/292
5,975,529 * 11/1999 de Keller ..... 273/292
6,045,129 * 4/2000 Cooper et al. ..... 273/292

* cited by examiner

*Primary Examiner*—Mark S. Graham
*Assistant Examiner*—Raeann Gorden
(74) *Attorney, Agent, or Firm*—Philip J. Anderson; Anderson & Morishita

(57) ABSTRACT

A method, device and system are set forth for playing a new Flush Poker card game. The method includes dealing a thirteen card hand to the player. The player selecting a group of suited cards from the thirteen card hand to hold and therefore discarding the remaining cards. The player is dealt replacement cards for the discarded cards. The hand is evaluated for a qualifying hand ranking based on a new variation of poker ranking. Winning hands are paid according to a predetermined pay schedule based on hand rankings and amounts wagered. The device includes a processor programmed to play the game according to the method. The system provides for linking devices to amass a progressive jackpot should the player obtain a qualifying hand.

5 Claims, 3 Drawing Sheets

FIG. 2

*FIRST DATA STRUCTURE*

44 SELECT WAGER
BET 1 CREDIT or BET MAX CREDIT or DEPOSIT COIN
DISPLAY TOTAL WAGERED
MAX WAGER REACHED?- NO GOTO 44
GOTO 46

46 DEAL CARDS AND DISPLAY
GOTO 47

47 PLAYER SELECTS SUIT
GOTO 48

48 DEAL REPLACEMENT CARDS AND DISPLAY
GOTO 52

*SECOND DATA STRUCTURE*

52 CHECK FOR QUALIFYING HAND RANKINGS

13 CARD FLUSH?
12 CARD FLUSH?
11 CARD FLUSH?
10 CARD FLUSH?
NO- 9 CARD FLUSH? YES
8 CARD FLUSH?
7 CARD FLUSH?
6 CARD FLUSH?
5 CARD FLUSH?
GOTO 44

13 CARD STRAIGHT?
12 CARD STRAIGHT?
11 CARD STRAIGHT?
10 CARD STRAIGHT?
NO 9 CARD STRAIGHT? YES
8 CARD STRAIGHT?
7 CARD STRAIGHT?
6 CARD STRAIGHT?
5 CARD STRAIGHT?
GOTO 54

54 PAY TABLE IF PROGRESSIVE NO GOTO 58

56 PAY PLAYER PROGRESSIVE
GOTO 44

58 PAY PLAYER
GOTO 44

FLUSH POKER CARD GAME

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention relates to electronic five card draw video poker games. Generally, the electronic five card draw video poker games deal five cards to the player from a standard 52 card poker deck. The player can hold or discard any of the five cards dealt and redraw to replace discarded cards from the remaining cards in the standard 52 card poker deck. The object of the game is to achieve the highest five card standard poker ranking. Many of these games offer a progressive payout for the top ranking hand, the Royal Flush. Because the Royal Flush is relatively easy to achieve in draw poker, the progressive jackpot payout is limited. In order to achieve a substantial progressive jackpot payout, the odds of obtaining the highest ranking hand would have to be at least one in a million. The present invention uses a thirteen card hand instead of a five card hand and a new variation of the five card standard poker rankings using straight flush and flush combinations, and offers players the ability to receive a substantial progressive jackpot payout for the highest ranking hands.

BRIEF SUMMARY OF THE INVENTION

The method of the present invention includes a player making a wager and receiving a thirteen card hand. The player selects a group of suited cards from the thirteen card hand therefore discarding the remaining cards. The player receives replacement cards for the discarded cards. The final thirteen card hand is ranked based on a new variation of the five card standard poker rankings of straight flush and flush combinations. The player is paid for winning hands according to a predetermined pay schedule.

Also according to the present invention, an electronic gaming device is set forth for playing the game of Flush Poker, the device including a processor having a first data structure representing each card of a standard deck of 52 cards (or the fifty-two cards plus a Joker) and means for randomly selecting from the data structure a thirteen card player hand. The processor further includes a second data structure of qualifying hand payoff combinations. A display is provided to display the player's cards. Means are provided for accepting a wager representing an actual monetary wager or a fictitious wager and for initiating the play of the game. Means are provided for the player to select a group of suited cards therefore discarding the remaining cards. The processor provides replacement cards for discarded cards and then compares the player's hand to a predetermined qualifying hand ranking and the player is paid according to a predetermined pay schedule for qualifying hands.

Further, the gaming devices according to the present invention may be interlinked within a gaming facility or between gaming facilities and provide for allocation of a portion of each wager to one or more progressive jackpots to be awarded if a player obtains a jackpot qualifying hand.

BRIEF DESCRIPTION OF THE DRAWINGS

These and other features and advantages of the present invention will become better appreciated with reference to the specifications, claims and drawings wherein:

FIG. 2 is a logic schematic for the processor of the device of FIG. 1.

DETAILED DESCRIPTION OF THE INVENTION

Figure 1:
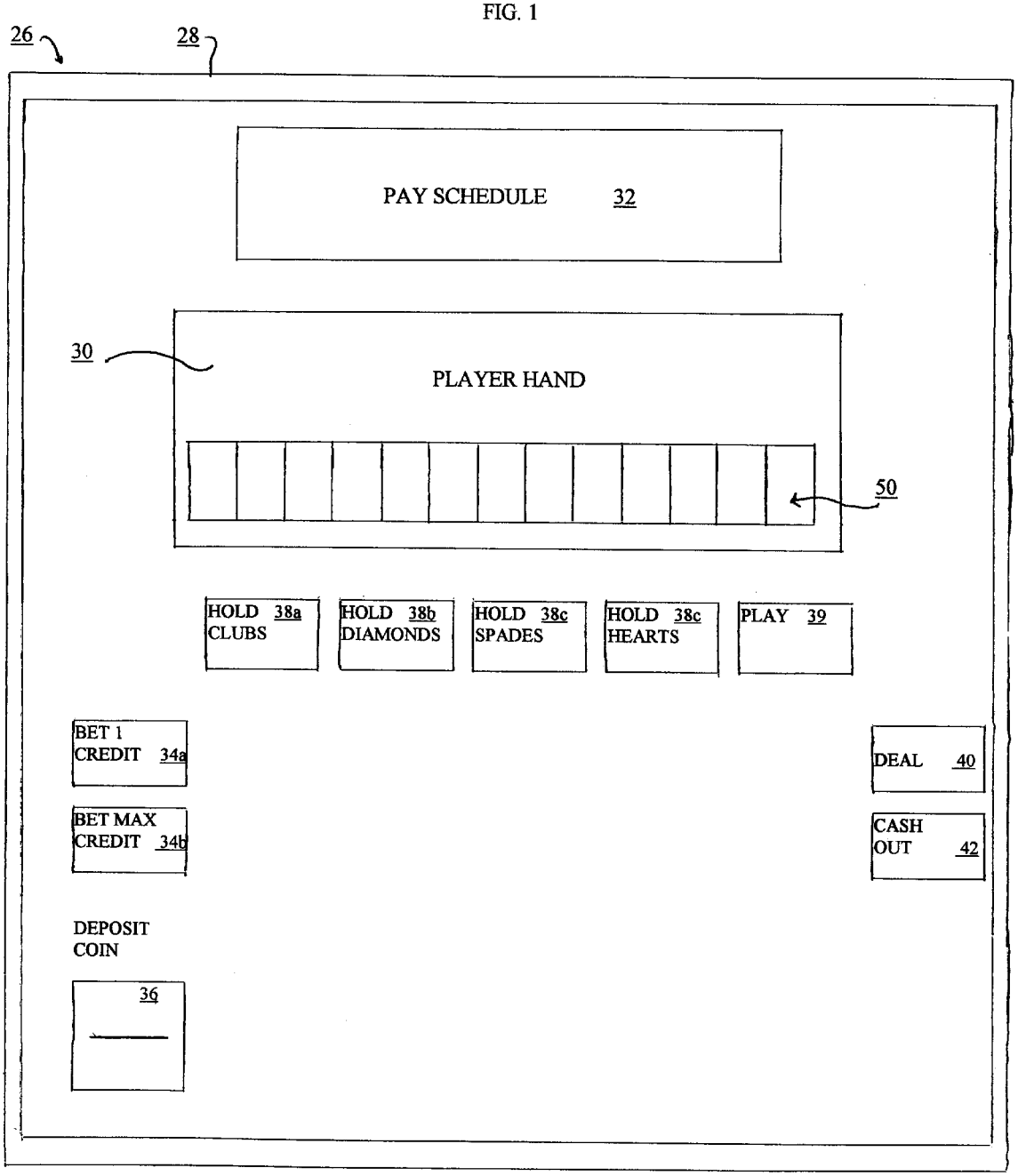
FIG. 1 Illustrates a display of an electronic device for playing the game of the present invention.

The object of the new Flush Poker game according to the present invention, is to obtain the highest thirteen card qualifying hand ranking. Qualifying hand rankings are based on the data represented in Table 1 below. It is to be understood that the terms straight flush and flush are based on traditional poker hand rankings and terminology.

TABLE 1

| Ranking | Description |
|---|---|
| 1 | 13 Card Straight Flush |
| 2 | 12 Card Straight Flush |
| 3 | 12 Card Flush containing an 11 Card Straight Flush |
| 4 | 12 Card Flush containing a 10 Card Straight Flush |
| 5 | 12 Card Flush containing a 9 Card Straight Flush |
| 6 | 12 Card Flush containing an 8 Card Straight Flush |
| 7 | 12 Card Flush containing a 7 Card Straight Flush |
| 8 | 12 Card Flush containing a 6 Card Straight Flush |
| 9 | 11 Card Straight Flush |
| 10 | 11 Card Flush containing a 10 Card Straight Flush |
| 11 | 11 Card Flush containing a 9 Card Straight Flush |
| 12 | 11 Card Flush containing an 8 Card Straight Flush |
| 13 | 11 Card Flush containing a 7 Card Straight Flush |
| 14 | 10 Card Straight Flush |
| 15 | 11 Card Flush containing a 6 Card Straight Flush |
| 16 | 10 Card Flush containing a 9 Card Straight Flush |
| 17 | 11 Card Flush containing a 5 Card Straight Flush |
| 18 | 10 Card Flush containing an 8 Card Straight Flush |
| 19 | 11 Card Flush |
| 20 | 10 Card Flush containing a 7 Card Straight Flush |
| 21 | 10 Card Flush containing a 6 Card Straight Flush |
| 22 | 10 Card Flush containing a 5 Card Straight Flush |
| 23 | 10 Card Flush |
| 24 | 9 Card Straight Flush |
| 25 | 9 Card Flush containing an 8 Card Straight Flush |
| 26 | 8 Card Straight Flush |
| 27 | 9 Card Flush containing a 7 Card Straight Flush |
| 28 | 8 Card Flush containing a 7 Card Straight Flush |
| 29 | 9 Card Flush containing a 6 Card Straight Flush |
| 30 | 7 Card Straight Flush |
| 31 | 8 Card Flush containing a 6 Card Straight Flush |
| 32 | 9 Card Flush containing a 5 Card Straight Flush |
| 33 | 7 Card Flush containing a 6 Card Straight Flush |
| 34 | 8 Card Flush containing a 5 Card Straight Flush |
| 35 | 9 Card Flush |
| 36 | 6 Card Straight Flush |
| 37 | 7 Card Flush containing a 5 Card Straight Flush |
| 38 | 8 Card Flush |
| 39 | 6 Card Flush containing a 5 Card Straight Flush |
| 40 | 7 Card Flush |
| 41 | 5 Card Straight Flush |

It is to be understood that hand rankings and qualifying hands can be modified and or changed to provide different variations of the game according to the present invention.

To play the new Flush Poker game according to the present invention, the player makes a wager a thirteen card hand. It is noted that the game according to the present invention can be a standard deck of 52 playing cards or a deck of those same 52 playing cards plus a Joker. If a Joker is used, the Joker is wild to represent cards to complete a straight flush or flush.

The player then selects a group of suited cards to hold. For example, if the thirteen card hand contained three clubs, five diamonds, two spades and three hearts, the player would select all the cards in the suit of diamonds in hopes of drawing additional diamonds to make a qualifying hand. When the player selects a suit of cards, the remaining cards are discarded and replaced with new cards from the original deck. Now the player has a final thirteen card hand. The player compares the final thirteen card hand Table 1, above to determine if a qualifying hand can be made. Qualifying hands are based on the cards of one suit only. It does not matter that the suit held does not qualify, if a qualifying hand can be arranged using a different suit.

If the player has a qualifying hand, it is compared to the Pay Schedule referenced in Table 2, below to determine the amount of winnings due the player. Winning are paid to the player and the game is complete. If the player does not have a qualifying hand, the player's wager is forfeited. It is to be understood that the Pay Schedule can be modified and or changed to provide different variations of the game and different hold percentages according to the present invention.

TABLE 2

| Ranking | Description | Payout |
|---|---|---|
| 1 | 13 Card Straight Flush | 1000000 to 1 |
| 2 | 12 Card Straight Flush | 10000 to 1 |
| 3 | 12 Card Flush containing an 11 Card Straight Flush | 9000 to 1 |
| 4 | 12 Card Flush containing a 10 Card Straight Flush | 8000 to 1 |
| 5 | 12 Card Flush containing a 9 Card Straight Flush | 7000 to 1 |
| 6 | 12 Card Flush containing an 8 Card Straight Flush | 6000 to 1 |
| 7 | 12 Card Flush containing a 7 Card Straight Flush | 5000 to 1 |
| 8 | 12 Card Flush containing a 6 Card Straight Flush | 4000 to 1 |
| 9 | 11 Card Straight Flush | 1000 to 1 |
| 10 | 11 Card Flush containing a 10 Card Straight Flush | 900 to 1 |
| 11 | 11 Card Flush containing a 9 Card Straight Flush | 800 to 1 |
| 12 | 11 Card Flush containing an 8 Card Straight Flush | 700 to 1 |
| 13 | 11 Card Flush containing a 7 Card Straight Flush | 600 to 1 |
| 14 | 10 Card Straight Flush | 500 to 1 |
| 15 | 11 Card Flush containing a 6 Card Straight Flush | 500 to 1 |
| 16 | 10 Card Flush containing a 9 Card Straight Flush | 400 to 1 |
| 17 | 11 Card Flush containing a 5 Card Straight Flush | 400 to 1 |
| 18 | 10 Card Flush containing an 8 Card Straight Flush | 300 to 1 |
| 19 | 11 Card Flush | 300 to 1 |
| 20 | 10 Card Flush containing a 7 Card Straight Flush | 200 to 1 |
| 21 | 10 Card Flush containing a 6 Card Straight Flush | 100 to 1 |
| 22 | 10 Card Flush containing a 5 Card Straight Flush | 75 to 1 |
| 23 | 10 Card Flush | 50 to 1 |
| 24 | 9 Card Straight Flush | 20 to |

TABLE 2-continued

| Ranking | Description | Payout |
|---|---|---|
| 25 | 9 Card Flush containing an 8 Card Straight Flush | 15 to 1 |
| 26 | 8 Card Straight Flush | 10 to 1 |
| 27 | 9 Card Flush containing a 7 Card Straight Flush | 8 to 1 |
| 28 | 8 Card Flush containing a 7 Card Straight Flush | 7 to 1 |
| 29 | 9 Card Flush containing a 6 Card Straight Flush | 6 to 1 |
| 30 | 7 Card Straight Flush | 6 to 1 |
| 31 | 8 Card Flush containing a 6 Card Straight Flush | 6 to 1 |
| 32 | 9 Card Flush containing a 5 Card Straight Flush | 5 to 1 |
| 33 | 7 Card Flush containing a 6 Card Straight Flush | 5 to 1 |
| 34 | 8 Card Flush containing a 5 Card Straight Flush | 5 to 1 |
| 35 | 9 Card Flush | 5 to 1 |
| 36 | 6 Card Straight Flush | 4 to 1 |
| 37 | 7 Card Flush containing a 5 Card Straight Flush | 4 to 1 |
| 38 | 8 Card Flush | 4 to 1 |
| 39 | 6 Card Flush containing a 5 Card Straight Flush | 3 to 1 |
| 40 | 7 Card Flush | 3 to 1 |
| 41 | 5 Card Straight Flush | 2 to 1 |

Turning to the drawings, FIG. 1 illustrates the device 26 includes a housing 28 of the type commonly used for electronic slot machines and video poker machines. The housing 28 has contained therein processing means for processing data as hereinafter described. Further the housing 28 includes a display 30 which may be a conventional video terminal (VDT). Disclosed on the housing 28 above the display 30 is a pay table 32 listing the payoffs for qualifying hands according to the present invention. The pay table 32 may also, or alternately, be displayed at the display 30.

Below the display 30 are numerous buttons and controls to control the play of the game as hereinafter described. To provide a means for accepting a wager there is provided two bet buttons 34*a,b*, respectively, by which a player may wager a single credit or the maximum amount permitted on the machine, e.g. five credits. For example, if the device 26 is a machine adapted to receive wagers in dollar increments, the player depressing the bet one credit bet button 34*a* would wager a single credit (one dollar) each time the button is depressed. If the player depresses the maximum bet button 34*b*, the maximum of, for example, five credits (five dollars) would be wagered. Below the bet buttons 34*a,b* is a coin slot 36 to receive wagers made by a player. Alternatively or additionally, as is well known, a cash validator (not shown) may be incorporated into or used in conjunction with the device 26 to receive cash wagers to be applied as credits during play of the game. Below the display 30 are four selection buttons 38*a–d* by which the player, as described below, will control the game according to the present method.

With continuing reference to FIG. 1, there is also provided on the housing 28 a deal button 40 to indicated the play of the game, a play button 39 to indicate the play of the game and a cash out button 42 by which, in a known manner, the player may depress to cash out the credits accumulated during the play of the game. Not shown in FIG. 1 is a coin tray to receive the coins when cashing out.

Turning to FIG. 2, a logic schematic for the processor of the device 26 is shown. The processor may be of the type presently incorporated into machines such as video poker machines. The device 26 includes a means for accepting and determining the amount wagered. The wager may be a monetary wager, such as for example where the device 26 is used in a casino, or can be merely a fictitious wager such as where the game according to the present invention is played on a computer or handheld unit for entertainment purposes. These means for accepting a wager are shown generally as 44 (FIG. 2) and include a feature of accepting a deposited coin, such as having a coin inserted in coin slot 36 and for selecting maximum wager or a single token wager as described above. The display 30 includes a feature of displaying the total amount wagered for the player to confirm the appropriate wager. The processor by known means detects and stores in memory the total amount wagered.

Once the wager has been made, means are provided to enable the player to initiate play. Play may be initiated by the player making the maximum wager whereupon the processor, detecting the maximum wager, automatically initiates play. If less than a maximum wager has been made, the player depresses the deal button 40 (FIG. 1) to initiate play. When play is initiated, the processor from a first data structure 46 randomly selects thirteen cards for the player's hand 50. The first data structure 46 includes data representing each of the 52 cards of a standard deck or, where a modified deck is used, the 52 cards of a standard deck plus a Joker. In the first data structure at 46 the randomly selected cards for the player's hand 50 are sorted according to suits e.g. Clubs, Diamonds, Spades and Hearts as shown in FIG. 2 and are displayed on the display 30.

Once the player's hand 50 has been displayed on the display 30, means are provided for the player to select a group of suited cards to hold. As shown in FIG. 1, the selection may be made by depressing one of the selection buttons 38*a–d* that correspond with the group of suited cards the player wants to hold. When one of the selection buttons 38*a–d* is depressed the corresponding suited cards are highlighted or otherwise distinguished from the remaining cards to be discarded on the display 30. Once the player is satisfied that they have selected the appropriate suit, the player depresses the play button 39 or deal button 40 signaling the processor as indicated at 48 on FIG. 2 to randomly select cards to replace the player's discards from the current deck being used. The replacement cards are displayed in place of the discards in the player's hand on the display 30, as shown on FIG. 2 in the first data structure at 48.

With reference to FIG. 2, the processor with a comparison test sequence 52 tests the player's hand 50 for the existence of thirteen cards all of the same suit. If a thirteen card same suit hand does not exist, the processor then tests for the existence of a twelve card straight flush. If a twelve card straight flush does not exist, the processor continues the sequence of testing as illustrated in FIG. 2. The player's hand 50 is then compared at 56 to a progressive jackpot also stored in the second data structure 54, described below, to determine whether or not the player qualifies for a progressive jackpot. If indeed the player does qualify, the processor issues a signal resulting in payment of the jackpot to the player as shown at 58.

If the player does not qualify for the progressive jackpot, the processor compares at 56 to a predetermined qualifying payoff combinations stored in a second data structure 54. Preferably the second data structure 54 includes the payoff combinations listed above in Table 1. If the players hand qualifies for a payout, the processor issues a signal resulting in payment to the player as shown at 58. After the hand is resolved as above, the player makes a new wager to play a new hand and initiates play.

As can be appreciated, the device 26 as described above provides an exciting video version of the game according to the present invention. The progressive jackpots for predetermined hand rankings will afford traditional video poker player's with an opportunity to receive enormous progressive jackpots.

Figure 3:
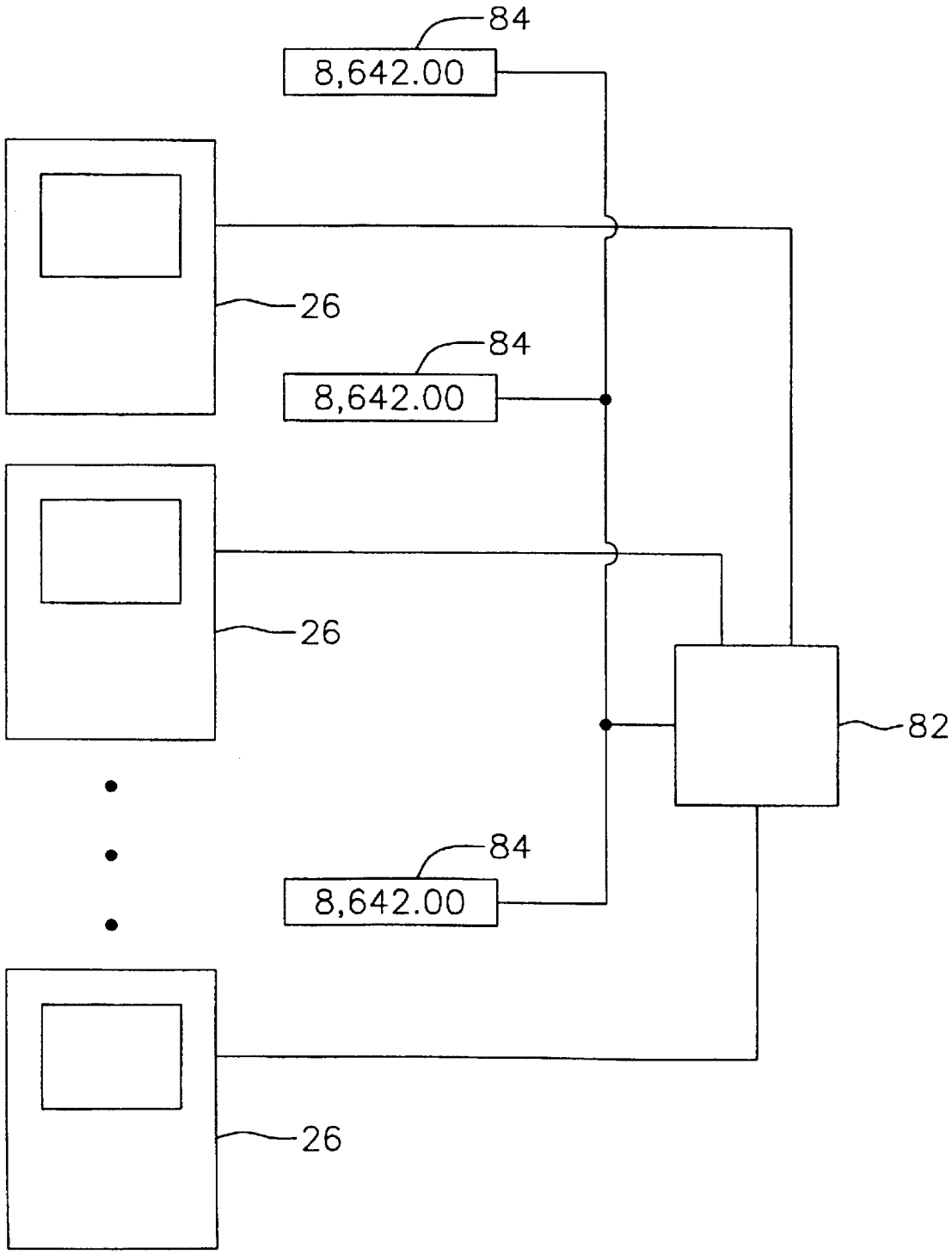
FIG. 3 is a schematic view illustrating a system including electronic gaming devices linked to provide a progressive jackpot.

With reference to FIG. 3 yet a further feature of the present invention is shown. Like components have like reference numerals.

According to this embodiment, several of the devices 26 are interconnected by suitable communications links to a master controller 82. The master controller 82 polls the processor of each device 26 and based upon the wagers received thereat, allocates a portion of each wager to assemble a progressive jackpot. The links between the devices 26 may be within a particular casino or may be linked throughout different casinos. It is to be understood that the greater the number of the devices 26 interconnected with the master controller the faster the progressive jackpot will grow. the master controller 82 in turn is linked to a progressive jackpot display 84 which may be included with the displays 30 of each device 26 or may be on a separate display associated with each device 26. The progressive jackpot displays 84 display the current amount of the progressive jackpot.

To be awarded the progressive jackpot, the player must obtain a qualifying progressive jackpot holding of the player's hand 50. Preferably, this progressive jackpot holding is a thirteen card Straight Flush. It is understood that any other progressive jackpot combination can be used to award the progressive jackpot. Further it is to be understood that lesser progressive jackpots can also be provided for other qualifying hand combinations. For example, a secondary progressive jackpot can also be assembled by the master controller 82 and displayed at each of the progressive jackpot displays 84. If the player obtains a predetermined secondary progressive jackpot holding, the player would be awarded the secondary progressive jackpot. As but an example, the secondary progressive jackpot may be a twelve card Straight Flush or the like.

While we have shown and described certain embodiments to the present invention it is to be understood that it is subject to many modifications and changes not departing from the spirit and scope of the claims presented herein. For example, where the device display 30 incorporates a touch screen feature the selection buttons may be incorporated into the touch screen display or the selection of cards for the player's hand could be made by the player touching the selected cards. Further, other payouts could be used to adjust the advantage to the casino. The invention is defined in the following claims.

I claim:

1. A method for playing a card game using a deck of at least 52 playing cards comprising:

the player making a wager;

from the deck dealing thirteen cards to the player to define a single player hand;

the player opting to discard one or more cards from the player hand and receive from the deck replacement cards therefor, said hand with or without replacements defining a single player hand;

if the final player hand of thirteen cards constitutes one of a pre-selected schedule of qualifying flush, straight or straight flush holdings only, issuing a reward to the player based on said wager; and if the final player hand does not constitute one of said schedule of qualifying flush, straight or straight flush holdings, collecting the player's wager.

2. The method of claim 1 including designating the predetermined schedule of designated qualifying holding consisting of the following,

| |
|---|
| 13 Card Straight Flush |
| 12 Card Straight Flush |
| 12 Card Flush containing an 11 Card Straight Flush |
| 12 Card Flush containing a 10 Card Straight Flush |
| 12 Card Flush containing a 9 Card Straight Flush |
| 12 Card Flush containing an 8 Card Straight Flush |
| 12 Card Flush containing a 7 Card Straight Flush |
| 12 Card Flush containing a 6 Card Straight Flush |
| 11 Card Straight Flush |
| 11 Card Flush containing a 10 Card Straight Flush |
| 11 Card Flush containing a 9 Card Straight Flush |
| 11 Card Flush containing an 8 Card Straight Flush |
| 11 Card Flush containing a 7 Card Straight Flush |
| 10 Card Straight Flush |
| 11 Card Flush containing a 6 Card Straight Flush |
| 10 Card Flush containing a 9 Card Straight Flush |
| 11 Card Flush containing a 5 Card Straight Flush |
| 10 Card Flush containing an 8 Card Straight Flush |
| 11 Card Flush |
| 10 Card Flush containing a 7 Card Straight Flush |
| 10 Card Flush containing a 6 Card Straight Flush |
| 10 Card Flush containing a 5 Card Straight Flush |
| 10 Card Flush |
| 9 Card Straight Flush |
| 9 Card Flush containing an 8 Card Straight Flush |
| 8 Card Straight Flush |
| 9 Card Flush containing a 7 Card Straight Flush |
| 8 Card Flush containing a 7 Card Straight Flush |
| 9 Card Flush containing a 6 Card Straight Flush |
| 7 Card Straight Flush |
| 8 Card Flush containing a 6 Card Straight Flush |
| 9 Card Flush containing a 5 Card Straight Flush |
| 7 Card Flush containing a 6 Card Straight Flush |
| 8 Card Flush containing a 5 Card Straight Flush |
| 9 Card Flush |
| 6 Card Straight Flush |
| 7 Card Flush containing a 5 Card Straight Flush |
| 8 Card Flush |
| 6 Card Flush containing a 5 Card Straight Flush |
| 7 Card Flush |
| 5 Card Straight Flush. |

3. The method of claim 2 including paying the player for a qualifying holding according to the following,

| | |
|---|---|
| 13 Card Straight Flush | 1000000 to 1 |
| 12 Card Straight Flush | 10000 to 1 |
| 12 Card Flush containing an 11 Card Straight Flush | 9000 to 1 |
| 12 Card Flush containing a 10 Card Straight Flush | 8000 to 1 |
| 12 Card Flush containing a 9 Card Straight Flush | 7000 to 1 |
| 12 Card Flush containing an 8 Card Straight Flush | 6000 to 1 |
| 12 Card Flush containing a 7 Card Straight Flush | 5000 to 1 |
| 12 Card Flush containing a 6 Card Straight Flush | 4000 to 1 |
| 11 Card Straight Flush | 1000 to 1 |
| 11 Card Flush containing a 10 Card Straight Flush | 900 to 1 |
| 11 Card Flush containing a 9 Card Straight Flush | 800 to 1 |
| 11 Card Flush containing an 8 Card Straight Flush | 700 to 1 |
| 11 Card Flush containing a 7 Card Straight Flush | 600 to 1 |
| 10 Card Straight Flush | 500 to 1 |
| 11 Card Flush containing a 6 Card Straight Flush | 500 to 1 |
| 10 Card Flush containing a 9 Card Straight Flush | 400 to 1 |
| 11 Card Flush containing a 5 Card Straight Flush | 400 to 1 |
| 10 Card Flush containing an 8 Card Straight Flush | 300 to 1 |
| 11 Card Flush | 300 to 1 |
| 10 Card Flush containing a 7 Card Straight Flush | 200 to 1 |
| 10 Card Flush containing a 6 Card Straight Flush | 100 to 1 |
| 10 Card Flush containing a 5 Card Straight Flush | 75 to 1 |
| 10 Card Flush | 50 to 1 |
| 9 Card Straight Flush | 20 to 1 |
| 9 Card Flush containing an 8 Card Straight Flush | 15 to 1 |
| 8 Card Straight Flush | 10 to 1 |
| 9 Card Flush containing a 7 Card Straight Flush | 8 to 1 |
| 8 Card Flush containing a 7 Card Straight Flush | 7 to 1 |
| 9 Card Flush containing a 6 Card Straight Flush | 6 to 1 |
| 7 Card Straight Flush | 6 to 1 |
| 8 Card Flush containing a 6 Card Straight Flush | 6 to 1 |
| 9 Card Flush containing a 5 Card Straight Flush | 5 to 1 |
| 7 Card Flush containing a 6 Card Straight Flush | 5 to 1 |
| 8 Card Flush containing a 5 Card Straight Flush | 5 to 1 |
| 9 Card Flush | 5 to 1 |
| 6 Card Straight Flush | 4 to 1 |
| 7 Card Flush containing a 5 Card Straight Flush | 4 to 1 |
| 8 Card Flush | 4 to 1 |
| 6 Card Flush containing a 5 Card Straight Flush | 3 to 1 |
| 7 Card Flush | 3 to 1 |
| 5 Card Straight Flush | 2 to 1. |

4. The method of claim 1 further including allocating a portion of each wager to a progressive jackpot and paying the progressive jackpot to a player if the player has a qualifying jackpot hand holding.

5. The method of claim 1 including dealing the cards from a standard fifty-two card deck plus a Joker, said Joker designated as wild to represent any card in a Straight Flush or Flush.

* * * * *